United States Patent [19]

Randol

[11] 4,084,329

[45] Apr. 18, 1978

[54] PROTRACTOR-TYPE HATCHING CONTROL DEVICE

[76] Inventor: Glenn Talley Randol, 3 E. 2nd Ave., Mountain Lake Park, Md. 21550

[21] Appl. No.: 729,691

[22] Filed: Oct. 5, 1976

[51] Int. Cl.[2] ..... B43L 13/24

[52] U.S. Cl. ..... 33/115; 33/110

[58] Field of Search ..... 33/110, 40, 81, 115–120

[56] References Cited

U.S. PATENT DOCUMENTS

| | | | |
|---|---|---|---|
| 72,036 | 12/1867 | Haynes | 33/110 |
| 1,076,095 | 10/1913 | Brown | 33/117 |
| 1,632,267 | 6/1927 | Beem | 33/81 |
| 2,051,741 | 8/1936 | Parker | 33/110 |
| 2,735,185 | 2/1956 | Naphtal | 33/120 |
| 3,846,914 | 11/1974 | Lam et al. | 33/110 |

*Primary Examiner*—Richard E. Aegerter
*Assistant Examiner*—John W. Shepperd

[57] ABSTRACT

A protractor-type hatching control device having a base segment (leg) cooperable with a straight-edge or the like movably mounted on a drawing board, including an adjustable hatching segment (leg) having a drawing-edge for controlling a drawing instrument (pen or pencil), and pivotally-connected to the base segment for setting to different angles at will for establishing angularity of the hatching; or line-spacer (indexer) carried by the adjustable segment, and settable at will to differently spaced positions relatively to the drawing-edge for uniformly controlling the selected spacing between the hatching drawn by said instrument in working contact with the drawing-edge; a knurled knob threaded on a stem defines the pivotal connection, for locking the hatching segment and line-spacer in their adjusted positions, and release of the know accommodates setting of the line-spacer and/or adjustable segment according to the desired line spacing and angle, respectively; and a provision for knife-like closing of the device by nesting the adjustable element in the base segment for compactness in storing or marketing.

3 Claims, 5 Drawing Figures

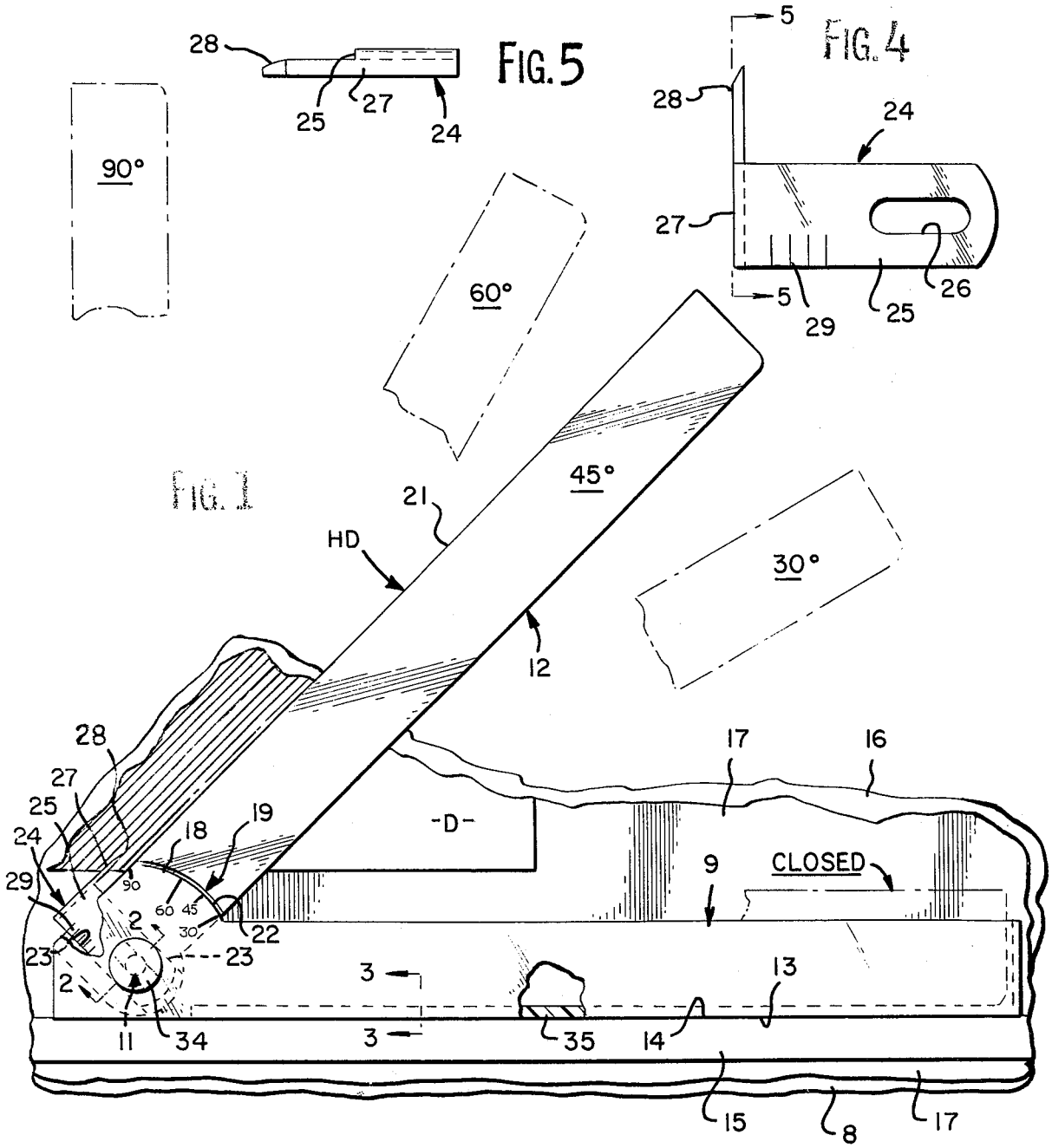
FIG. 5
28
25
27
24
FIG. 4
5
28
24
27
26
5
29
25
90°
60°
45°
30°
FIG. 1
21
HD
12
28
27
25
24
29
23
2
2
18
19
90
60 45
30
22
23
-D-
17
16
9
CLOSED
3
3
13
11
34
35
14
15
8
17
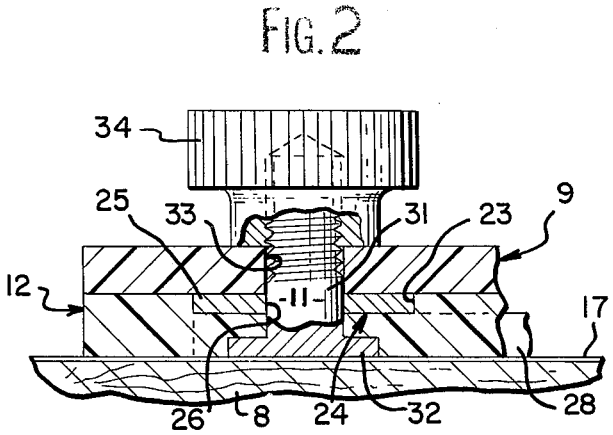
FIG. 2
34
25
33
31
23
9
12
11
17
26
8
24
32
28
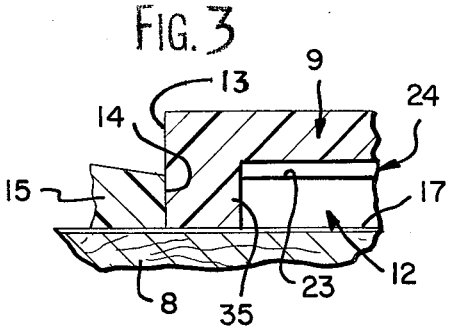
FIG. 3
9
13
14
24
15
17
12
8
35
23

PROTRACTOR-TYPE HATCHING CONTROL DEVICE

This invention relates generally to drawing devices, and more particularly to a new and improved protractor-type hatching control device for guiding a drawing instrument such as a pen or pencil, relative to a cooperating straight-edge or the like, according to the selected angularity and spacing of the hatching.

The invention corresponds substantially to that disclosed in a proposed patent specification and illustrated by accompanying informal drawings, filed in the Patent Office June 8, 1976 as a Disclosure Document under identifying number 049,973.

The broad objective of the invention is to provide such a novel device with a base segment (leg) cooperable with said straight-edge, and an adjustable segment (leg) having selective open operating positions for controlling vertical and different angular hatchings, and a knife-like closable capability with respect to the base segment for compactness in storing or in packaging for the market, and wherein the adjustable segment when closed is inoperative for hatching.

A feature relating to the broad objective, is the provision of an adjustable segment having a drawing- (working) edge settable to 30°, 45°, 60°, and 90° positions, for example, for drawing a series of equally-spaced lines at the selected angle setting, and an adjustable line-spacer co-rotatable with the adjustable segment enabling visual positioning of the device along said straight-edge for drawing such lines along the drawing-edge by a drawing instrument (pen or pencil) moving in working contact with the former.

Another feature is an imprinted scale on the line-control spacer (indicator), selectively registerable with the drawing-edge aforesaid to establish the width of the lines as selected.

Another feature is a graduated arc defining a protractor imprinted on the base segment concentrically with respect to the pivotal connections between the base and adjustable segments, to define 30-45-60-90° settings of the adjustable segment, and a pointer imprinted on the latter segment is adapted to register with the arc graduations to facilitate selective setting of the adjustable segment to the angle desired.

Another feature resides in a threaded stem fast on one end of the adjustable segment and projecting through an elongated aperture (opening) in the line-control indicator thence through a hole in the overlapping end portion of the base segment, and a lock-nut threaded on the exposed threaded portion of the stem for simultaneously locking the adjustable segment and line-control indicator in their respective settings on the base segment according to the selected angle and spacing of the lines.

A still further feature resides in the two segments of the hatching control device being closable in knife-like manner in overlying coextensive relationship for compactness in storing after use or in packaging for mailing in marketing the device.

Features and advantages not specifically mentioned above, will become apparent to persons skilled in the related art from the following comprehensive description considered with the drawings in which the reference characters applied to the several views (figures) designated similar and corresponding parts and assemblies thereof.

In the drawing:

FIG. 1 is a plan view showing a fragmentary portion of a drawing board and paper attached thereto, and a movable straight-edge (T-square) in operative association with the hatching control device embodying the present invention, said device being shown in open drawing position against the controlling-edge of said straight-edge with the adjustable segment (leg) set at 45° angle and the line-control indicator positioned for uniformly controlling one-sixteenth inch spacing, for example, between the lines;

FIG. 2 is a transverse section taken on an enlarged scale along the line 2—2 of FIG. 1 to clarify structural details of the lock-nut controlled pivotal connection between the two segments of the device;

FIG. 3 is another transverse section taken on an enlarged scale along the line 3—3 of FIG. 1, showing the marginal flange on the underside of the base segment for maintaining the latter parallel to the adjustable hatching segment as the base segment moves along the controlling-edge of the straight-edge;

FIG. 4 is a plan view of the line-control spacer per se showing the elongated aperture in its rectangular portion slidably supported in a channel transversely formed across the pivotal connection between two segments of the hatching control device, said aperture accommodating a pivotal element to project through a hole in the base segment, and also serves to prevent fortuitous displacement of the spacer out of the channel; and FIG. 5 is a side elevation of the line-control spacer as viewed from the line 5—5 of FIG. 4.

As shown in FIGS. 1, 2 and 3, I have disclosed the novel and improved protractor-type hatching control device embodying the present invention operably positioned on a drawing board 8, and generally designated "HD", said device including structure defining a base segment (leg) 9 pivotally-connected at 11 to an adjustable segment (leg) 12, said segments being preferably formed from acrylic plastic material for transparency. The base segment 9 is of generally rectangular elongated configuration and provided with a lower (bottom) working-edge 13 slidably cooperable with a control-edge 14 on a straight-edge (T-square) 15 movable on the drawing board 8 and to which is applied a sheet of drawing paper 17 on which a drawing "D" is to be hatched, and shown in progress in FIG. 1. The left end portion of the base segment 9 is formed with an arcuate portion defining a protractor 18 concentrically-oriented with respect to the pivotal connection 11 (see FIG. 1). The protractor 18 is imprinted on its arcuate margin with graduations (marks) designating angular settings of the adjustable segment 12 relative to the base segment 9, such as 30°, 45°, 60° and 90°, for example. An imprinted pointer 19 is applied to the adjustable segment 12 as shown, which is registerable with the graduations aforesaid to indicate the angular setting aforesaid of the adjustable segment 12.

The adjustable segment 12 is of generally rectangular configuration, and is provided with a drawing- (working) edge 21, and having its lower end portion profiled complementally to the corresponding left end portion of the base segment 9. An embossment 22 of similar profile to the lower end portion of the adjustable hatching segment 12, is integrally formed atop the latter segment and provided with a transverse channel 23 across the pivotal center of said embossment normal to th drawing-edge 21.

A line-control spacer 24 is characterized by a rectangular plate 25 provided with an elongated perforation (aperture) 26, and a transversely disposed downturned end flange 27 defining a line-pointer 28 (see FIGS. 4 and 5). The plate 25 is slidably positioned in the channel 23 flush with the top of the embossment 22, the depth of the former being the same as the thickness of the plate 25. The left end portion of the base segment 9 is mounted in stacked relation in close tolerance adjacency to said plate 25. A scale 29 is inscribed on the lower edge margin of the plate 25 best shown in FIG. 4, to provide accurate measurement of the spacing between the hatching in parts of an inch, such as sixteenths, for example, as shown in FIG. 1. The graduations of the scale 29 are selectively registerable with the drawing-edge 21 to facilitate accurate setting of the line-control spacer 24 according to the desired spacing of the hatching. For example, if the hatching is to be spaced one-sixteenth of an inch, the draftsman would position the line-control spacer 24 for the first graduation to align with the drawing-edge 21 as shown in FIG. 1, which would space the line-pointer 28 approximately three thirty-seconds of an inch from the drawing-edge 21 to allow space for the point of the drawing instrument, to move along the latter in working contact therewith to produce such one-sixteenth spacing. Thereafter, repeated positioning of the line-pointer 28 in registery with the last line drawn automatically spaces the new line to be drawn the selected one-sixteenth of an inch from the previously drawn line. Should wider spacing of the hatching be desired, the line-control spacer 24 would be set accordingly, that is, for three thirty-seconds spacing, for example, the first two graduations would be set equidistant with respect to the drawing-edge 21, or for one-eighth inch spacing, the second graduation would be aligned with the drawing-edge 21, etc., as is understood.

The pivotal connection 11 aforesaid between the base and adjustable segments 9, 12, respectively, include structure defining an upstanding threaded stem 31 with its lower end fast on the adjustable segment as by an integral flange 32 embedded therein, said stem being adapted to project through the aperture 26 in the plate 25 of the line-control spacer 24, to extend through a hole 33 in the protractor portion of the base segment 9 to expose the threaded free end portion of the stem for a knurled lock-nut (knob) 34 to threadingly engage the same simultaneously lock the adjustable segment and line-control spacer 24 having operative interposition with respect to the protractor portions of the segments 9 and 12, in their adjusted positions of 45° and one-sixteenth inch spacing between the lines, for example, as shown in FIGS. 1 and 2.

The base and adjustable segments 9,12, respectively, may be closed parallel to each other in knife-like fashion as shown by dashed line position of the upper end portion of the segment 12, at the right end of the base segment 9 in FIG. 1, for compactness in storing the device HD when not in use, or in packaging for the market.

A control flange 35 integrally extends along the bottom margin in part and the right end margin of the base segment 9, in the same plane and thickness as the segment 12 for the undersides of the latter and flange 35 to move continuously to the drawing paper 17 when hatching (see FIGS. 1 and 2). The outer edge of this flange is flush with the bottom edge of the segment 9, and defines the working-edge 13 on the segment 9, which slidably cooperates with the control-edge 14 on the straight-edge (T-square) 15. The control flange 35 produces space in the base segment 9, for reception of the control segment 12 when the device HD is closed as shown by dashed lines in FIG. 1.

OPERATIONAL SUMMARY: The device HD is placed on the drawing paper 17 mounted on the drawing board 8 in its adjusted angular and line-spacing positions, with the working-edge 13 set against the control-edge 14 of the straight-edge (T-square) 15. The distance between the crossmatching is set by releasing the lock-nut 34 and then moving the line-spacer 24 to position its line-pointer 28 accordingly, and the angularity of the lines to be drawn is established by rotating the adjustable segment 12 to register its pointer 19 with the graduation on the protractor 18 corresponding to the desired hatching; whereupon, the locknut 34 is tightened to simultaneously lock the segments 9,12 and interposed line-control spacer 24 in their respective adjusted positions in readiness for the hatching operation. The hatching device HD is now conditioned for hatching by bringing the line-pointer 28 in slightly overlapping relationship with respect to the base line of the drawing D to be hatched. The first line is drawing with a pen or pencil working against the drawing-edge 21 of the adjustable segment 12, following which the hatching device HD is moved to the right, for example, until the line-pointer 28 is over the first line, and a second line is drawn, which operation is repeated until the drawing is hatched. It is easy to move the hatching device HD repetitively to the set distance for each succeeding line without imposing eye-strain or tension otherwise on the draftsman in producing equally spaced lines under visual control of merely aligning the line-pointer 28 with the previously drawn line. Therefore, guess-work is taken out of this phase of drawing in visually estimating the distance between the lines with conventional drawing triangles.

The drawing-edge 21 of the adjustable segment 12, provides versatility in that it may be used for either drawing to produce layouts or hatching the latter thus enabling the present hatching device HD to carry out all of the functions provides by separate conventional 30°–60° and 45° drawing triangles which are devoid of hatching control.

The marginal flange 35 on the base segment 9 provides space for the adjustable segment 12 when the hatching device HD is closed for storage after use or for compactness in marketing. This flange has a further novel utility of increasing lateral stability of the device HD on the drawing D to facilitate penciling of inking the latter, and maintaining parallelism with the adjustable segment 12 as previously pointed out.

Moreover, the protractor 18 on the base segment 9 enables adjusting the angularity of the adjustable segment 12 not only to the imprinted calibrated degrees but to any degree of angularity between such calibrations as is understood, which further contributes to the versatility of the present hatching control device HD. Also, movement of the hatching device HD along the straight-edge 15 as a hatching operation progresses, is facilitated by manually grasping the knurled knob 34 between the thumb and the index and adjacent fingers which enables thrust to be applied on the hatching device toward the drawing board 8 to stabilize the former in its newly selected position for the new line to be drawn.

Accordingly, it is seen that my novel and improved hatching control device HD is effective to control uniform spacing between crosshatched lines with minimal tension and/or eye-strain on the part of the draftsman, without impairing normal use of the hatching device as a drawing device such as a triangle, and has a definite value, particularly, when a draftsman is involved in a large number of sectional drawings which require a high degree of accuracy in outlining and sectioning the depiction.

In view of the foregoing comprehensive description augmented by the drawing, it should be evident that my invention discloses a novel hatching control device of simple construction, easily adjusted and manipulated, and economical to produce, for uniform spacing of hatching with minimal effort and attention on the part of the draftsman, and which is adaptive to achieve its objectives and features first-mentioned as well as those appearing in the body of the above description.

Whereas, the drawing illustrates, and the above description sets forth a preferred embodiment of the invention, it is to be understood that the invention contemplates any variations in structure, and equivalents and modifications which may come under the terms of the subjoined claims, compatible with the state of the related art.

Having thus described my invention, I claim:

1. A protractor-type hatching control device having a base segment movable along a straight-edge or the like, and a hatching control segment having a leading drawing-edge and adjustable with respect to the base segment to establish different angularities of hatching, a pair of overlying protractor portions on said segments, respectively, and concentrically-oriented with respect to a common axis with one portion graduated in degrees selectively registrable with a reference mark on the other portion to facilitate setting the control segment in its selected hatching angularity, wherein the improvement comprises: a control flange defining the working-edge of the base segment slidable along the straight-edge, said flange producing in the base segment space for reception of the control segment when the device is inoperative; a transverse channel indented normal to the drawing-edge in the protractor portion of the control segment; a line-spacing control member slidably disposed in the channel between the protractor portions for establishing the selected hatching space; a threaded stem defining the common axis with one end fast on one of the protractor portions, and projecting through an aligned-hole in the other protractor portion; and a locknut threadingly engaging the free end of the threaded stem to lock the protractor portions and slidably interposed control member in adjusted positions to move as a unit with their respective segments for hatching.

2. The hatching control device as claimed in claim 1 wherein the control member is a rectangular plate slidably disposed in the transverse channel between the protractor portions to rotate as a unit with the control segment when the locknut is released, said plate being characterized by a longitudinal slot through which the threaded stem passes and a downturned flange defining a line-pointer parallel to the drawing-edge on the control segment, said line-pointer being registrable with each succeeding hatching line to uniformly control the spacing between the lines according to the selected space between the line-pointer and drawing-edge, as a function of moving the device along the straight-edge.

3. The hatching control device as claimed in claim 2 wherein a side margin of the plate is imprinted with a scale graduated in fractions of an inch, which are adapted to register with the drawing-edge on the control segment to selectively establish the desired hatching space.

* * * * *

UNITED STATES PATENT OFFICE

CERTIFICATE OF CORRECTION

PATENT NO. 4,084,329

DATED April 18, 1978

INVENTOR(S) :GLENN TALLEY RANDOL

It is certified that error appears in the above-identified patent and that said Letters Patent are hereby corrected as shown below:

In the drawing, FIG. 1, for "16" read -- 8 --; column 2, line 66, for "th" read -- the --; column 3, line 39, for "include" read -- includes --; line 48, after "same" insert -- to --; line 64, for "continuously" read -- contiguously --; column 4, line 10, for "crossmatching" read -- crosshatching --; line 23, for "drawing" read -- drawn --; line 50, for "of" read -- or --.

In the Abstract, line 8, for 'or' read --a--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*